United States Patent [19]

Kohus

[11] Patent Number: 4,778,068

[45] Date of Patent: Oct. 18, 1988

[54] BABY-FEEDING BOTTLE

[75] Inventor: Louis M. Kohus, Cincinnati, Ohio

[73] Assignee: KohusMariol Inc., Cincinnati, Ohio

[21] Appl. No.: 124,972

[22] Filed: Nov. 24, 1987

[51] Int. Cl.[4] ..... A61J 9/00; A61J 9/06; B65D 23/00

[52] U.S. Cl. ..... 215/11.1; 215/100 A; 220/4 A

[58] Field of Search ..... 215/6, 11.1, 11.3–11.6, 215/10, 100 A; 220/4 A–4 E, 94 A

[56] References Cited

U.S. PATENT DOCUMENTS

| | | | |
|---|---|---|---|
| 815,883 | 3/1906 | Van Blarcom | 215/6 X |
| 1,434,460 | 11/1922 | Tibbatts | 215/11.1 X |
| 2,326,414 | 8/1943 | Thompson | 215/6 X |
| 2,873,881 | 2/1959 | Nichols | 220/4 A X |
| 3,134,494 | 5/1964 | Quinn | 215/11.3 |
| 4,703,863 | 11/1987 | Kohus | 215/11.1 |

*Primary Examiner*—William Price
*Assistant Examiner*—Sue A. Weaver
*Attorney, Agent, or Firm*—Dressler, Goldsmith, Shore, Sutker & Milnamow, Ltd.

[57] ABSTRACT

A baby-feeding bottle convertible between one of larger capacity, e.g., ten fluid ounces, and one of smaller capacity, e.g., five fluid ounces. A lower part and an upper part when assembled to each other, at a threaded connection, provide a container of larger capacity. The lower part is useful, as a container of lower capacity, without the upper part. A collar is useful to mount a pliable nipple on either part. The threaded connection is peripherally covered by an annular rim, which is integral with the upper part, and which substantially conforms to an outer wall of the container provided by the lower and upper parts assembled to each other so as to present a substantially uninterrupted gripping surface to a user.

6 Claims, 1 Drawing Sheet

10
12
14
16
20
22
24
26
28
30
32
34
36
38
40
42
44
46
48
50
52
54
56
4

BABY-FEEDING BOTTLE

FIELD OF THE INVENTION

This invention pertains to improvements in baby-feeding bottles.

BACKGROUND OF THE INVENTION

It is known for a baby-feeding bottle to be convertible between one of larger capacity, e.g., ten fluid ounces, to one of smaller capacity, e.g., five fluid ounces. Such a bottle is known as a "two-stage" bottle. Examples of such a bottle are disclosed in U.S. Pat. No. 4,703,863, which is assigned commonly herewith.

As disclosed in U.S. Pat. No. 4,703,863, a gripping section of reduced diameter relative to other portions of such a bottle is provided at a threaded connection between two parts of the bottle. The gripping section helps a small child to handle the bottle by himself or herself.

SUMMARY OF THE INVENTION

This invention provides a baby-feeding bottle of an improved design. The bottle is convertible between one of larger capacity, e.g., ten fluid ounces, and one of smaller capacity, e.g., five fluid ounces.

Broadly, the bottle comprises a lower part and an upper part, which when assembled to each other provide a container of larger capacity with an outer wall, which preferably is conical but alternatively may be otherwise configured.

Specifically, the lower part has an upper neck, which has an external connecting formation. Likewise, the upper part has a lower neck, which has an internal connecting formation. The lower neck of the upper part is adapted to be connectingly engaged with the upper neck of the lower part so as to assemble the lower and upper parts to each other. Moreover, the upper part also has an upper neck, which has an external connecting formation like the external connecting formation of the lower part.

The upper necks of the lower and upper parts extend upwardly. The lower neck of the upper part extends downwardly. Each neck has a smaller circumferential dimension compared to the outer wall noted above.

Additionally, the bottle comprises a collar, which has an internal connecting formation like the internal connecting formation of the lower neck of the upper part. The collar is adapted to be connectingly engaged with the upper neck of either of the lower and upper parts. The collar is further adapted to mount a nipple removably on the upper neck of whichever of the lower and upper parts the collar is engaged with.

Additionally, the bottle comprises peripheral rim means for peripherally enclosing the lower neck of the upper part and the upper neck of the lower part and substantially conforming to the outer wall provided by these parts when these parts are assembled to each other. Preferably, a peripheral rim integral with one of these parts constitutes the peripheral rim means. Preferably, the peripheral rim is integral with the upper part.

Preferably, the external connecting formations of the respective necks are external threads, and the internal connecting formations of the lower neck and the collar respectively are internal threads. Thus, the collar may be of a conventional, threaded type. Also, whether or not the collar is threaded, the nipple may be of a conventional, collar-mounted type.

Accordingly, when the lower and upper parts are assembled to each other so as to provide a container of larger capacity, the peripheral rim means substantially conforms to the outer wall provided by these parts so as to present a substantially uninterrupted gripping surface to a user. Thus, if the outer wall is conical, the gripping surface is conical.

However, if it is desired to provide a container of smaller capacity, the nipple may be removably mounted on the upper neck of the lower part by means of the collar.

These and other objects, features, and advantages of this invention will be further evident from the following description of a preferred embodiment of this invention, with reference to the accompanying drawing.

DETAILED DESCRIPTION OF PREFERRED EMBODIMENT

Figures 1, 2, 3, 4:
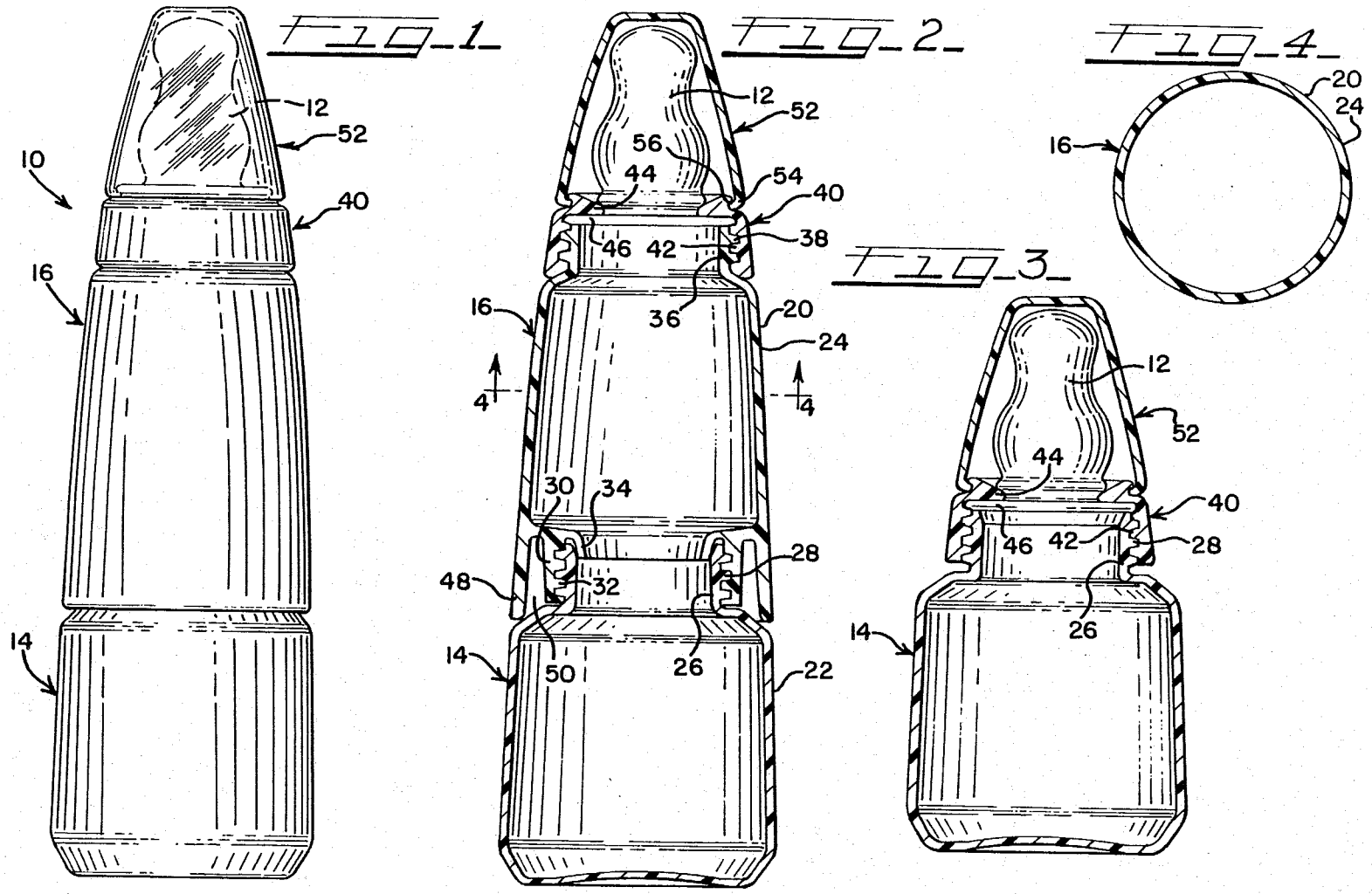
FIG. 1 is an elevational view of a baby-feeding bottle constituting a preferred embodiment of this invention, as converted to one of larger capacity.
FIG. 2 is a view taken in axial section through the same bottle, as shown in FIG. 1, with a nipple and a cover for the nipple being also shown.
FIG. 3 is a view taken in axial section through the same bottle, as converted to one of smaller capacity.
FIG. 4 is a cross-sectional view taken along lines 4—4 of FIG. 2 in a direction indicated by arrows.

As shown in the drawing, a baby-feeding bottle 10 constituting a preferred embodiment of this invention is combined with a pliable nipple 12 of a conventional, collar-mounted type. The baby-feeding bottle 10 is convertible from one of larger capacity, e.g., ten fluid ounces, to one of smaller capacity, e.g., five fluid ounces.

Broadly, the baby-feeding bottle 10 comprises a lower part 14 and an upper part 16, which when assembled to each other in a manner to be hereinafter described provide a container of larger capacity with an outer wall 20, of which a lower portion 22 is provided by the lower part 14 and an upper portion 24 is provided by the upper part 16. Preferably, as shown, the outer wall 20 is conical. Alternatively, the outer wall 20 may be cylindrical. Preferably, as shown, the outer wall 20 is circular in cross-section. Alternatively, the outer wall 20 may be otherwise configured, e.g., elliptical in cross section or polygonal with rounded corners in cross-section.

Specifically, the lower part 14 has an upper neck 26, which has an external thread 28 constituting an external connecting formation. Likewise, the upper part 16 has a lower neck 30, which has an internal thread 32 constituting an internal connecting formation. The lower neck 30 is adapted to be connectingly engaged with the upper neck 26, by the lower neck 30 being threaded onto the upper neck 26, so as to assemble the lower part 14 and upper part 16 to each other. The lower neck 30 is provided with an inner lip 34, which bears against the upper neck 26 so as to provide a liquid-tight seal. Moreover, the upper part 16 also has an upper neck 36, which has an external thread 38 like the external thread 28 of the upper neck 26 of the lower part 14, so as to constitute an external connecting formation like the external connecting formation constituted by the external thread 28.

Additionally, the baby-feeding bottle 10 comprises a collar 40, which has an internal thread 42 like the internal thread 32 of the lower neck 30 of the upper part 16, so as to constitute an internal connecting formation like the internal connecting formation constituted by the internal thread 32. The collar 40 is adapted to be connectingly engaged either with the upper neck 26 of the lower part 14 or with the upper neck 36 of the upper part 16.

Although the external and internal threads noted above are preferred, other external and internal connecting formations may be alternatively used, e.g., bayonet-type connecting formations or snap-on connecting formations.

The collar 40 is further adapted to mount the pliable nipple 12 removably on whichever of the lower part 14 and the upper part 16 the collar 40 is engaged with. The collar 40 is similar to known collars for baby-feeding bottles in that the collar 40 has an annular flange 44, which overlies an annular flange 46 of the pliable nipple 12 when the collar 40 is used to mount the pliable nipple 12.

When the collar 40 is used to mount the pliable nipple 12 on the upper neck 36 of the upper part 16, the lower part 14 and the upper part 16 having been assembled to each other, the baby-feeding bottle 10 is converted to one of larger capacity, e.g., ten fluid ounces. When the collar 40 is used to mount the pliable nipple 12 on the upper neck 26 of the lower part 14, the upper part 16 having been removed, the baby-feeding bottle 10 is converted to one of smaller capacity, e.g., five fluid ounces.

Additionally, the baby-feeding bottle 10 comprises a peripheral rim 48, which is integral with the upper part 16. When the lower part 14 and the upper part 16 are assembled to each other, the peripheral rim 48 peripherally encloses the lower neck 30 of the upper part 16 and the upper neck 26 of the lower part 14 and substantially conforms to the outer wall 20, of which the lower portion 22 is provided by the lower part 14 and the upper portion 24 is provided by the part 16, so that the peripheral rim 48 and the outer wall 20 present a substantially uninterrupted gripping surface to a user. Alternatively, but far less preferably, a peripheral rim integral with the lower part 14 may replace the peripheral rim 48, or peripheral rims integral with the respective upper and lower parts and dimensioned so as to engage or approximate each other when these parts are assembled to each other may replace the peripheral rim 48.

Preferably, as shown, a recess 50 is provided between the peripheral rim 48 and the lower neck 30 of the upper part 16. So as to facilitate cleaning, the recess 50 should have no sharp internal corners. Preferably, as shown, the recess 50 is continuous in a peripheral sense. Alternatively, the recess 50 may be traversed by radial ribs (not shown) connecting the peripheral rim 48 and the lower neck 30 of the upper part 16, or the recess 50 may be eliminated.

Preferably, each component of the baby-feeding bottle 10 is molded from a synthetic, polymeric material, which is selected for its suitability for use in a baby-feeding bottle. Alternatively, glass may be used for the upper and lower parts, although a washer (not shown) may have to be then used to provide a liquid-tight seal therebetween. Different materials may be used for the upper and lower parts, for which transparency may be desirable, and for the collar, for which opacity may be desirable.

Additionally, as shown, a transparent cap 52 may be used to cover the pliable nipple 12. The cap 52 may be also molded from a suitable synthetic polymeric material. As shown, the lower edge 54 of the cap 52 is configured so as to snap removably into a peripheral recess 56 formed in the collar 40.

Further modifications may be made without departing from the spirit of this invention.

I claim:

1. A baby feeding bottle, which is convertible between one of a larger capacity and one of a smaller capacity, said bottle comprising:

(a) a lower part and an upper part, which when assembled to each other provide a container of larger capacity with an outer wall; the lower part being useful, as a container of smaller capacity, without the upper part; the lower part having an upper neck, which extends upwardly, and which has a smaller circumferential dimension compared to the outer wall, and which has an external connecting formation; the opper part having a lower neck, which extends downwardly, which has a smaller circumferential dimension compared to the outer wall, which has an internal connecting formation, and which is adapted to be connectingly engaged with the upper neck of the lower part so as to assemble said parts to each other; the upper part also having an upper neck, which extends upwardly, which has a smaller circumferential dimension compared to the outer wall, and which has an external connecting formation like the external connecting formation of the upper neck of the lower part;

(b) a collar, which has an internal connecting formation like the internal connecting formation of the lower neck of the upper part, which is adapted to be connectingly engaged with the upper neck of either of said parts, and which is further adapted to mount a nipple removably on the upper neck of whichever of said parts the collar is engaged with; and (c) peripheral rim means for peripherally enclosing the lower neck of the upper part and the upper neck of the lower part and substantially conforming to the outer wall provided by said parts when said parts are assembled to each other;

whereby, when said parts are assembled to each other, the peripheral rim means and the outer wall of the container provided by said parts present a substantially uninterrupted gripping surface to a user.

2. A baby-feeding bottle according to claim 1 wherein the peripheral rim means is integral wihh one of said parts.

3. A baby-feeding bottle according to claim 1 wherein the peripheral rim means is integral with the upper part.

4. A baby-feeding bottle according to claim 1 wherein the outer wall of the container provided by said parts when assembled to each other is conical.

5. A baby-feeding bottle according to claim 1 wherein the external connecting formations of the respective upper necks are external threads, and wherein the internal connecting formations of the lower neck and the collar respectively are internal threads.

6. A baby-feeding bottle according to claim 5 wherein the peripheral rim means is integral with the upper part.

* * * * *